United States Patent [19]

Augsburger

[11] 4,262,636

[45] Apr. 21, 1981

[54] METHOD OF STARTING A FORCED-FLOW STEAM GENERATOR

[75] Inventor: Walter Augsburger, Hettlingen, Switzerland

[73] Assignee: Sulzer Brothers Limited, Winterthur, Switzerland

[21] Appl. No.: 76,987

[22] Filed: Sep. 20, 1979

[30] Foreign Application Priority Data

Oct. 3, 1978 [CH] Switzerland ..... 10241/78

[51] Int. Cl.[3] ..... F22B 35/44

[52] U.S. Cl. ..... 122/406 ST; 122/1 B; 122/7 R

[58] Field of Search ..... 122/1 R, 1 B, 1 C, 406 S, 122/406 ST, 407, 7 R

[56] References Cited

U.S. PATENT DOCUMENTS

| | | | |
|---|---|---|---|
| 3,021,824 | 2/1962 | Profos | 122/406 ST |
| 3,035,557 | 5/1962 | Litwinoff | 122/406 ST |
| 3,212,477 | 10/1965 | Gerber et al. | 122/406 ST |
| 3,530,836 | 9/1970 | Caravatti | 122/406 ST |
| 3,532,453 | 10/1970 | Zipay et al. | 122/406 ST |
| 3,789,804 | 2/1974 | Aguet | 122/1 R |
| 4,182,274 | 1/1980 | Williams | 122/406 ST |
| 4,194,468 | 3/1980 | Augsburger | 122/406 ST |

*Primary Examiner*—Henry C. Yuen

*Attorney, Agent, or Firm*—Kenyon & Kenyon

[57] ABSTRACT

At the start up of the forced-flow steam generator, water is supplied through a line into a radiation-heated superheater heating surface while the by-pass valve connected to the output line of the final superheater is closed. This produces a steam cushion or buffer which initially inhibits the formation of steam in the tube panel (evaporator). Subsequently, the by-pass valve is partly opened to produce a steam flow which cools the superheaters. When the pressure in the steam generator reaches the range of pressures corresponding to the starting pressure of the turbine, feeding of the steam generator with water is started. The heat consumed for starting is therefore reduced.

3 Claims, 2 Drawing Figures

METHOD OF STARTING A FORCED-FLOW STEAM GENERATOR

Figure 1:
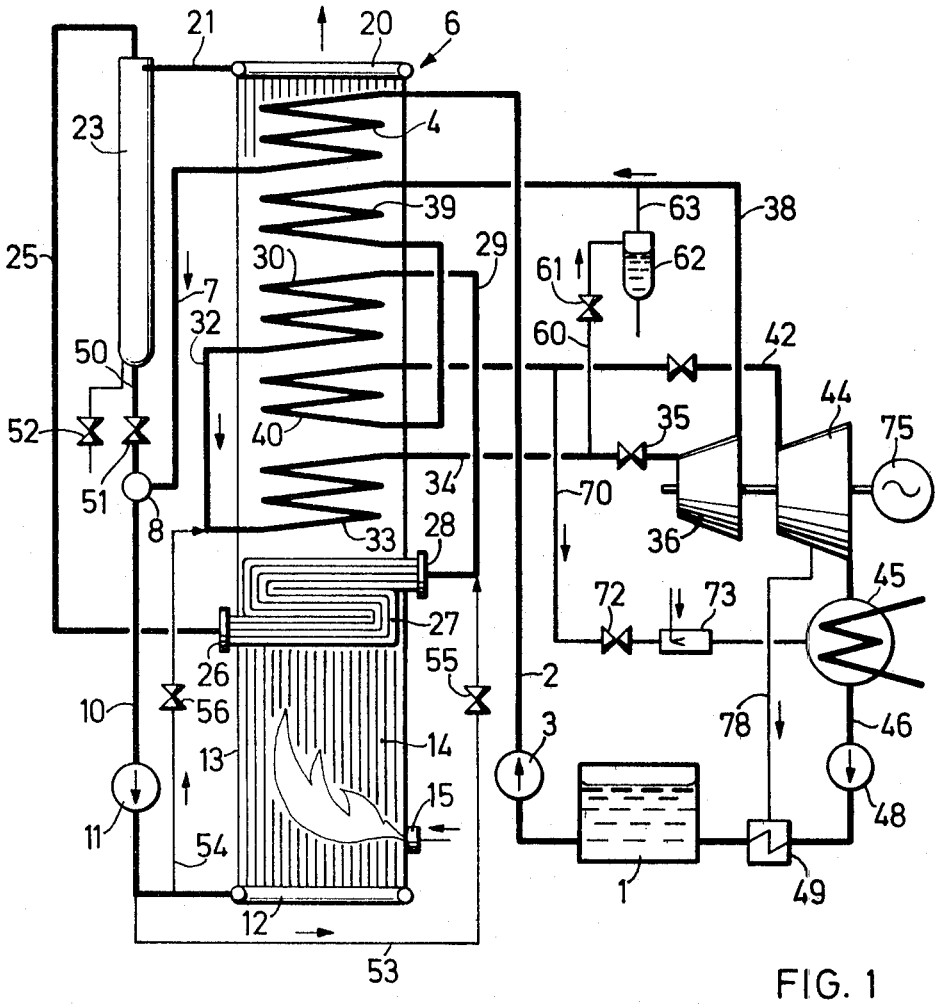

This invention relates to a method of starting a forced-flow steam generator.

As is known, various types of forced-flow steam generators have been used to deliver steam to a turbine in order to produce electricity or other work. In some cases, the forced-flow steam generators have been constructed with an economiser, an evaporator and a superheater heating surface which experiences flame radiation whereby the evaporator includes a circulating pump. Conventionally, steam generators of this type are started from a cold state on low feed and while unpressurized. In such cases, the steam evolves rapidly with one part being used to preheat incoming water while the remainder is blown off to waste until the steam is of sufficiently high quality to preheat and start the turbine. In this procedure, the minimum feed is determined by economizer considerations since evaporation must be prevented to occur in the economiser.

It is an object of this invention to improve the starting of a forced-flow steam generator which supplies steam to a turbine.

It is another object of the invention to substantially reduce the amount of heat required for the starting up operation of a forced-flow steam generator without any risk of evaporation occurring in the economizer of the steam generator.

It is another object of the invention to provide a simple method of starting up an existing forced-flow steam generator with reduced heat without requiring substantial modification of the steam generator.

Briefly, the invention is directed to a forced-flow steam generator which is constructed with an evaporator heating surface which defines a combustion chamber and incudes a circulating pump for circulating a working medium, such as water, through the evaporator heating surface. In addition, the steam generator includes a starting burner in the combustion chamber, an economizer heating surface within a flue gas passage, at least one superheater within the flue gas passage to experience flame radiation and a valve means is disposed at an outlet of the steam generator.

The method of starting the steam generator begins with an initial filling of the economizer and evaporator heating surfaces with a working medium, such as water. Thereafter, the circulating pump is started, the starting burner is ignited and a regulated quantity of working medium, i.e. water, is injected into the superheater for evaporation therein in order to build up a back-pressure to inhibit the formation of vapor in the economizer and evaporator heating surfaces. Next, the valve means is opened to produce a vapor flow for slighlty cooling the superheater. Finally, when the vapor pressure in the steam generator is coming into the range of a starting pressure for a turbine the feeding of the economiser begins.

One particular advantage of the start-up method is that the firing for given temperature gradients can be reduced. As a result, a more uniform temperature distribution can be obtained in the steam generator.

The flow section of the valve means is sized in dependence upon the output of the starting burner and upon the quantity of working medium introduced into the superheater heating surface whereby the circulated working medium reaches saturation at an outlet of the evaporator substantially simultaneously as the turbine starting pressure is reached. This provides the advantage that a once-for-all setting of the valve means, for example the turbine by-pass valve, is sufficient and no additional control means is necessary in addition to the conventional equipment.

The quantity of working medium which is injected into the superheater heating surface can be bled from the circulated working medium between the circulating pump and the evaporator. This provides a two-fold advantage. First, the water injected into the superheater heating surface receives an ever-increasing preheating. Second, there is no need to discharge water from the evaporator, a step which would cause heat loss, in a manner corresponding to the increase of the volume of water in the evaporator.

Use can be made of an existing injection line to supply the injected working medium to the superheater heating surface. Thus, there is no need to provide any additional line with a throttle in the steam generator sturcture.

Figure 2:
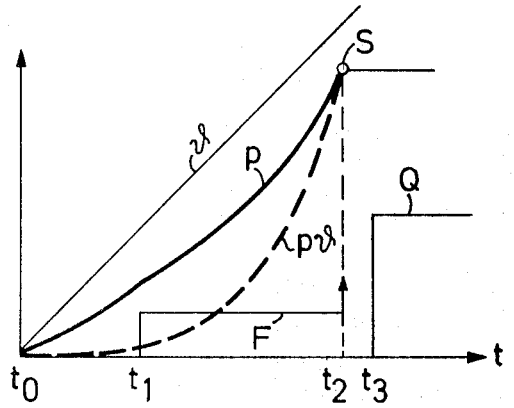

These and other objects and advantages of the invention will become more apparent from the following detailed description and appended claims taken in conjunction with the accompanying drawings in which:

FIG. 1 diagramatically illustrates a steam generator which can be started in accordance with the invention;

FIG. 2 diagramatically illustrates a manner in which the start-up method according to the invention proceeds in dependence upon time.

Referring to FIG. 1, a feed tank 1 containing a supply of working medium, for example, water is connected via a feed line 2 containing a feed pump 3 to an economizer 4 of a forced-flow steam generator 6. The steam generator 6 also includes an evaporator heating surface in the form of a tube panel 13 which defines a combustion chamber 14 at the bottom and a gas-tight flue gas passage which extends upwardly as viewed.

The economizer 4 is located within an upper end of the flue gas passage defined by the tube panel 13 and has an outlet which is connected via a connecting line 7 to a mixing tank 8 outside the tube panel 13. The mixing tank 8 is, in turn, connected by way of a circulating line 10 having a circulating pump 11 therein to a bottom distribution header 12 of the tube panel 13.

The steam generator 6 also has a plurality of burners (not shown) including a starting burner 15 which extends into the chamber 14.

The tubes of the tube panel 13 are connected at the top end of a collecting system 20 with an outlet which is connected to a line 21 which terminates tangentially in a separator 23. As shown, the separator 23 is connected at the top end via a steam line 25 to a distributor 26 of a superheater heating surface 27 disposed within the flue gas passage formed by the panel 13. The superheater heating surface 27 is positioned to experience flame radiation and thus acts as a radiation heating surface. The tubes of the superheater heating surface 27 extend to a collector 28 which, in turn, connects via a line 29 to a second superheater 30 within the flue gas passage. The outlet of this second superheater 30 communicates via a line 32 with the inlet of a third and final superheater 33 disposed above the superheater 27. A live-steam line 34 extends from the superheater 33 to a high-pressure turbine 36. As shown, a steam valve 35 is interposed in the line 34 to control the flow of steam to the turbine 36.

The turbine 36 is mounted on a common shaft with a medium-pressure turbine 44 and a generator 75. In addition, the high-pressure turbine 36 communicates via an outlet line 38 with a first re-superheater 39 disposed within the flue passage downstream of the superheaters 27, 33, 30 and upstream of the economizer 4. The re-superheater 39 has an outlet which connects to the input of a second re-superheater 40 disposed within the flue passage between the superheaters 30, 33. This re-superheater 40, in turn, connects via a line 42 having a valve therein with the inlet of the medium-pressure turbine 44.

As shown, the medium pressure turbine 44 is connected to a condenser 45 which has a condensate chamber therein which communicates via a line 46 having a condensate pump 48 and preheater 49 therein to the feed tank 1.

The bottom end of the separator 23 is connected via a line 50 having a valve 51 therein to the mixing tank 8. In addition, a drain pipe 9 extends from the bottom of the separator 23 in parallel with the line 50. This drain pipe 9 has a valve 52 therein to control a discharge of water from the separator 23.

Two injection lines 53, 54, each having an injection valve 55, 56, respectively, are connected to the circulation line 10 downstream of the pump 11 and extend to the lines 29, 32, respectively. In addition, a by-pass line 60 branches off from the live-steam line 34 between the final superheater 33 and the live-steam valve 35. This by-pass line 60 extends via a throttle, such as a by-pass valve 61, to a by-pass separator 62. This separator 62 has a vapor side connected via a line 63 to the input line 38 extending from the high pressure turbine 36 to the re-superheater 39.

Still further, a by-pass line 70 extends from the output line 42 of the second re-superheater 40 via a by-pass valve 72 and an injection cooler 73 to the condenser 45. Finally, a bleed line 78 extends from the medium pressure turbine 44 to the preheater 49 so as to deliver expanded steam thereto.

When the steam generator operates normally to deliver steam to the turbine set 36, 44, the pump 3 compresses water from the feed tank 1 to a pressure of 170 bars and delivers the water to the economizer 4 for preheating. After a thorough mixing in the mixing tank 8 with water from the separator 23, the resulting water is circulated via the circulating pump 11 through the tube panel 13 and separator 23. The vapor phase which evolves in the tube panel 13 separates from the water in the separator 23 and flows via the line 25 to the superheater heating surface 27. This vapor then flows via the line 29 to the superheaters 30, 33 and, thence, to the high pressure turbine 36 to be expanded therein with the performance of work. During passage from the high pressure turbine 36 to the medium pressure turbine 44, the steam is re-superheated in the re-superheaters 39, 40. The steam is then expanded to condenser pressure in the medium pressure turbine 44 and is finally condensed in the condensor 45. The condensate is then returned by means of the condensor pump 48 to the feed water tank 1.

During this normal operation, the valves 61, 72 are closed. Also, in known manner, water is injected into the superheated steam in order to adjust the temperature thereof by way of the injection valve 55, 66. For this purpose, the valves 55, 56 are operated by suitable controllers (not shown).

In order to start-up the steam generator, the following steps are carried out.

First, the economizer 4, tube panel 13 (evaporator) and separator 23 are filled with working medium, e.g. water, to an appropriate level. Filling is usually undertaken by means of the feed pump 3 whereby any surplus water being removed from the separator 23 through the drain pipe 9 via the valve 52. Thereafter, the circulating pump 11 is started at the time $t_0$ (FIG. 2) and the starting burner is ignited. Simultaneously, or shortly afterwards, a regulated quantity of water is injected into the superheater heating surface 27 through the line 53 and valve 55. Since the surface 27 experiences heavy flame radiation and has a relatively small iron mass and contains little water, relative to its heated area, the injected water starts to evaporate rapidly while the water circulating in the tube panel 13 is being preheated in accordance with the curve $\theta$.

As the pressure p rises, some steam which is produced in the superheater 27 condenses on the various flowed-through connecting lines and fittings and, in so doing heats the same. At the instant of time $t_1$ (FIG. 2), the by-pass valve 61 is opened to a predetermined position (throttle cross-section F). A first part of the steam which is produced therefore serves to raise the pressure while a second part, which rapidly becomes smaller, continues to condense on the cooler surfaces, and a third part flows through the superheater heating surfaces 30, 33 and by-pass valve 61 into the by-pass separator 62 and, thence, into the re-superheaters 39, 40 to cool or heat the same. Any condensate which evolves flows through the open valve 72 into the condensor 45.

The temperature $\theta$ of the water circulating in the tube panel 13 and the theoretically calculable vapor pressure $p\theta$ of the water rises in this phase until, finally, at the intersection S (FIG. 2) the vapor pressure $p\theta$ is equal to the pressure p in the superheater 27. Evaporation therefore takes place in the panel 13 such that the by-pass valve 61 which has been previously set as a pressure-retaining valve to the turbine starting pressure automatically opens to a further degree. The resulting increase in steam production causes the level in the separator 23 to drop to a critical value at which (at the time $t_3$) feeding of the steam generator starts at a delivery Q.

Warming up of the turbine 36 can start before or after the point S is reached. Once steam production in the tube panel 13 has begun, the turbine 36 can be started. Thereafter, the normal starting procedure begins and there is no more need for an intervention in the steam generator.

It is to be noted that as the working medium which is injected into the superheater heating surface 27 evaporates, there is a build up of a back-pressure which inhibits the formation of vapor in the economizer 4 and the tube panel 13. Further, the delivery of the steam to the turbine 36 and the feeding of working medium to the economizer 4 can also occur in response to the vapor pressure in the steam generator coming into the range of the starting pressure for the turbine 36.

Finally, it is to be noted that the superheater heating surface 27 near the panel 13 can extend in front of two or three or all four walls of the passage and not just one.

What is claimed is:

1. A method of starting a forced-flow steam generator having an economiser heating surface within a flue gas passage; an evaporator heating surface defining a combustion chamber and including a circulating pump for circulating a working medium through said evaporator heating surface; a starting burner in said combustion chamber; at least one superheater within said passage to experience flame radiation; a valve means downstream of said superheater at an outlet of the steam generator; said method comprising the steps of at least partial filling the economiser and evaporator heating surfaces with a working medium;

thereafter starting the circulating pump, igniting the burner, and injecting a regulated quantity of working medium into the superheater for evaporation therein to build up a backpressure to inhibit the formation of vapor in the economiser and evaporator heating surfaces;

thereafter opening the valve means to produce a vapor flow for slightly cooling the superheater; and when the vapor pressure in the steam generator coming into the range of a starting pressure for a turbine feeding the economiser heating surface with working medium.

2. A method as set forth in claim 1 wherein the flow section of the valve means is sized in dependence upon the output of the starting burner and upon the quantity of working medium introduced into the superheater heating surface whereby the circulated working medium reaches saturation at an outlet of the evaporator substantially simultaneously as the turbine starting pressure is reached.

3. A method as set forth in claim 1 wherein the quantity of working medium injected into the superheater heating surface is bled from the circulated working medium between the circulating pump and the evaporator.

* * * * *